US005755598A

United States Patent [19]

Taylor

[11] Patent Number: 5,755,598

[45] Date of Patent: May 26, 1998

[54] ELECTRICAL CONNECTORS

[75] Inventor: Christopher Charles Taylor, Gloucestershire, United Kingdom

[73] Assignee: Krone Aktiengesellschaft, Berlin-Zehlendorf, Germany

[21] Appl. No.: 637,852

[22] Filed: Apr. 25, 1996

[30] Foreign Application Priority Data

Apr. 27, 1995 [GB] United Kingdom ..... 9508593

[51] Int. Cl.[6] ..... H01R 13/66

[52] U.S. Cl. ..... 439/620; 439/404; 439/676

[58] Field of Search ..... 439/676, 620, 439/404, 405

[56] References Cited

U.S. PATENT DOCUMENTS

| | | | |
|---|---|---|---|
| 4,541,682 | 9/1985 | Gerke et al. . | |
| 4,820,192 | 4/1989 | Denkmann et al. . | |
| 5,091,826 | 2/1992 | Arnett et al. | 439/404 |
| 5,224,881 | 7/1993 | Lejuste et al. | 439/709 |

FOREIGN PATENT DOCUMENTS

| | | |
|---|---|---|
| 0 075 150 A2 | 9/1982 | European Pat. Off. . |
| 2 242 080 | 9/1991 | United Kingdom . |
| 2 282 273 | 3/1995 | United Kingdom . |

*Primary Examiner*—Gary F. Paumen
*Attorney, Agent, or Firm*—McGlew and Tuttle

[57] ABSTRACT

An electrical connector for use as a network terminating apparatus is provided including a front or cover plate assembly, an intermediate unit which in use is disposed behind the cover assembly and a backing unit. The intermediate unit carries diagnostic circuitry, an assembly of connecting devices, and one or more contact assemblies, and one or more sets of generally identical contact elements, which extend between and interconnect the elements carried by the intermediate unit. The connecting device may comprise a multi-way connector. Each contact may include an elongate strip-like, electrically conductive portion from which project, generally orthogonally, a plurality of contact arms, each the arm being disposed at a predetermined position so that it can make electrical contact with one of the elements carried by the intermediate unit. One of the contact arms may include an insulation displacement type contact.

8 Claims, 9 Drawing Sheets

ELECTRICAL CONNECTORS

FIELD OF THE INVENTION

This invention relates to electrical connectors. In particular, the invention relates to electrical connectors which are designed to provide a connection between a telecommunication or telephone line and a customers equipment, e.g. a telephone, a facsimile machine (fax), or similar equipment. The invention also relates to a contact for use in such an electrical connector.

BACKGROUND OF THE INVENTION

Electrical connectors for providing a connection between telephone equipment and a telephone line have been well-known for some considerable time and generally includes a molded faceplate which is wall-mounted and which includes an access opening for receiving a plug jack linked to a telephone handset or similar equipment. The access opening includes contacts which are linked by appropriate circuitry to a telephone line. With the increase in telecommunications functionality (facilities) and usage the requirements which these electrical connectors have to meet have become more complex and sophisticated and, as a consequence, they have to be capable of providing more functionality. This involves the use of more electrical circuitry and more complicated connections.

The most current requirements specify that such connectors or terminating equipment have to be able to provide inter alia a facility to provide the functionality which allows utility meters to be read over telephone wires, which allows a customer to wire his own extensions to the connector, which enables remote testing of the network from some central location and which provides currently existing functionality, and which has enhanced reliability against adverse environmental conditions.

In designing a connector which can meet these requirements it has become apparent that it is very difficult to achieve all these facilities and the related functionality with conventional connection techniques such as printed circuit boards or lead frames.

SUMMARY AND OBJECTS OF THE INVENTION

It is an object of the invention to provide an electrical connector, and also a contact for use in such a connector, which enables the requirements to be met without having to use complex lead frames or printed circuit board connections.

According to one aspect of the present invention there is provided an electrical connector for use as a network terminating apparatus, the connector comprising a front or cover plate assembly, an intermediate unit which in use is disposed behind the cover assembly, the intermediate unit carrying diagnostic circuitry, an assembly of connecting means, and one or more contact assemblies, and one or more sets of generally identical contact elements, which extend between and interconnect the elements carried by the intermediate unit. The connecting means may comprise a multi-way connector. Each contact may comprise an elongate strip-like, electrically conductive portion from which project, generally orthogonally, a plurality of contact arms, each the arm being disposed at a predetermined position so that it can make electrical contact with one of the elements carried by the intermediate unit. One of the contact arms may include an insulation displacement type contact.

The front face may include a removable access plate which, when removed, enables a customer to gain access to preselected contacts enabling that customer to carry out wiring. The access plate may carry contacts which, when the access plate is removed, cause the connector to be electrically isolated.

Another aspect of the present invention provides a contact for use in an electrical connector of the type defined above, the contact comprising an elongate, strip-like, electrically conductive portion from which project, generally orthogonally, a plurality of contact arms, the arms being disposed at predetermined positions so that they can make electrical contact with one or more elements mounted on the intermediate unit of the electrical connector. One of the contact arms may be formed with an insulation displacement type contact.

An important feature of the present invention is the recognition that by appropriately positioning the diagnostic means, the multi-way connector, and the contact assemblies on the intermediate unit it is possible to use a plurality of generally identical contacts to provide the necessary connection between those elements. Such contacts can be made relatively easily and cheaply and the invention, therefore, avoids the need to provide complicated lead frame assemblies, or printed circuit board connections.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
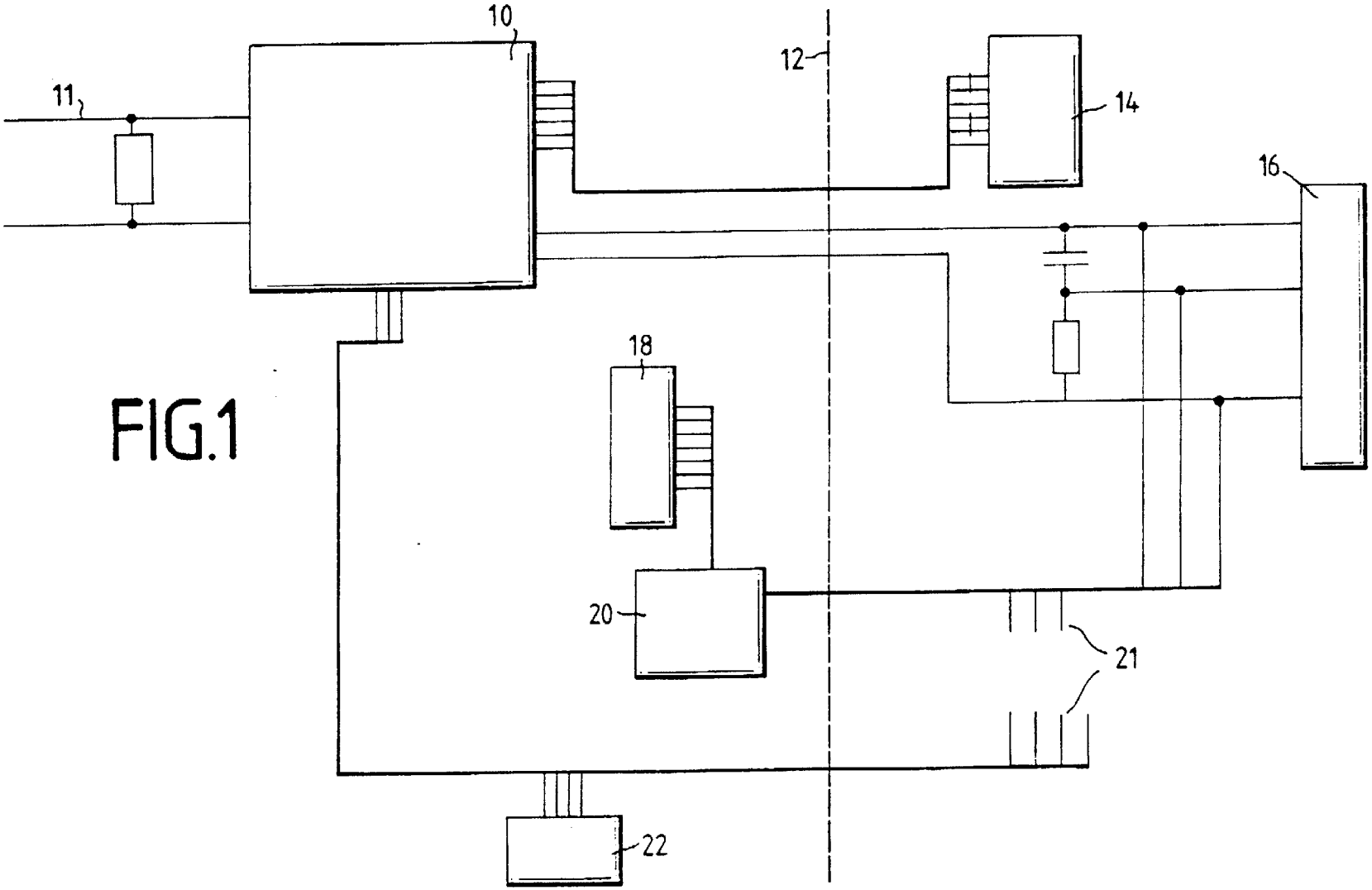
FIG. 1 is a schematic representation showing the functional requirements of current electrical connectors for use in terminating telecommunication lines.

Referring to the drawings in particular, FIG. 1 shows in schematic form the functional requirements of an electrical connector for terminating a line in a telecommunications network. The connector has to provide a diagnostic circuit, shown at 10, which can be connected to the incoming line 11. The diagnostic circuit 10 is linked by a multi-way connector illustrated schematically at 12 to a service ID module 14 and also to a conventional telephone socket 16. The service ID module is a module which by means of a simple 2 digit code can indicate to a remote station the type of service being provided at a particular termination.

The connector also has to provide a six way insulation displacement type contact (IDC) which is illustrated at 18. This can be accessed by a customer. The IDC 18 is connected by way of an isolation switch 20 through the multi-way connector to the telephone socket 16. Also provided are spare connections illustrated generally at 20 and a 4-way telemetry connector 22. The present embodiment is concerned with an electrical connector which, by means of a novel design of a multipurpose contact, can provide the above the in a simple and relatively inexpensive manner.

Figure 2:
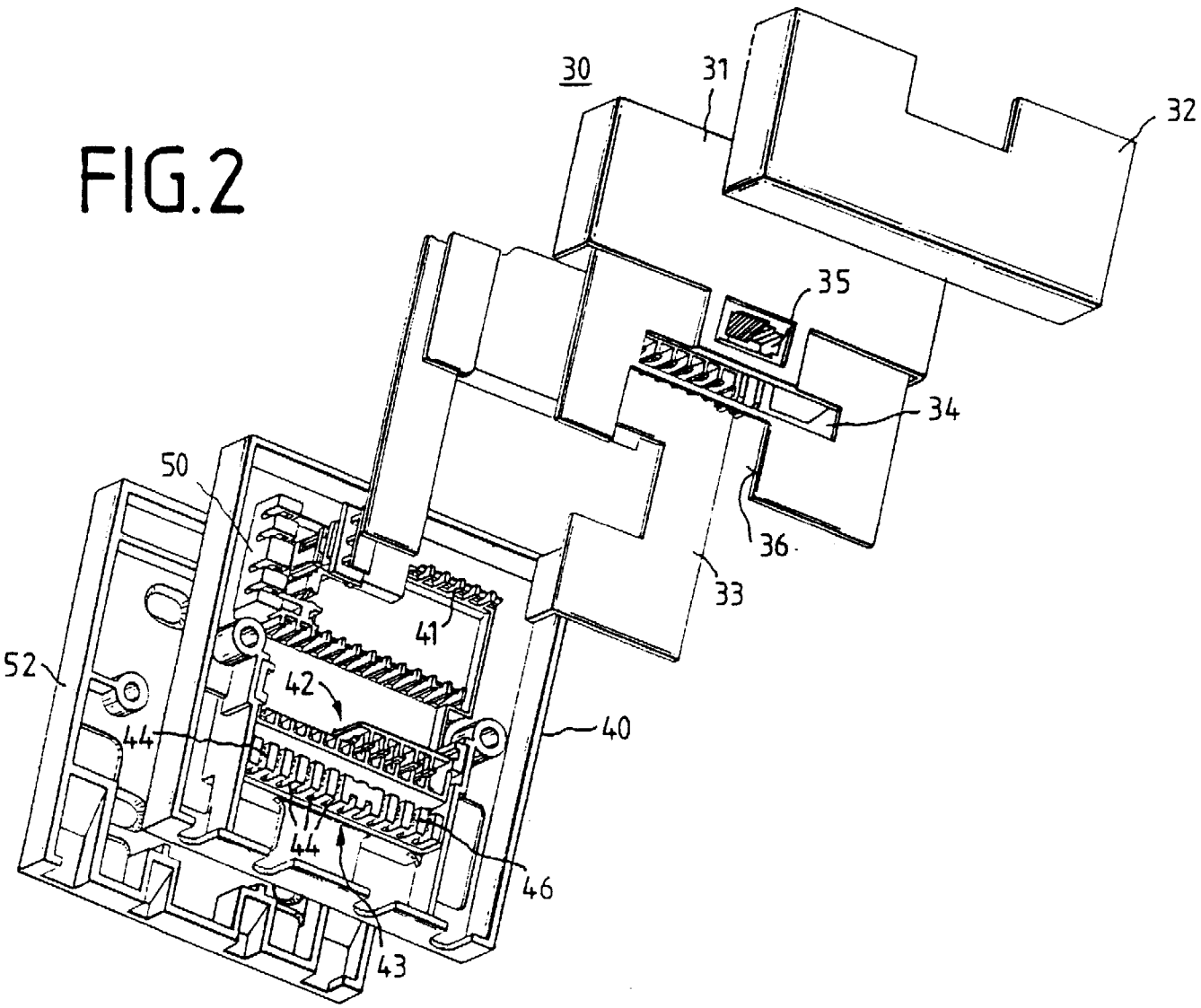
FIG. 2 is a schematic exploded view of an electrical connector in accordance with the present invention.

Referring now to FIG. 2, an electrical connector in accordance with one embodiment of the present invention comprises a molded front plate assembly shown generally at 30. The front plate assembly includes a front plate portion 31, an access plate 32, and a cover part 33. In use of the connector these three elements are normally located in juxtaposition so that the access plate covers an opening 34 in the front plate while leaving accessible the conventional opening 35 which can receive a telephone jack plug. The front plate portion 31 also has a cut-away part 36.

Disposed behind the front plate assembly is an intermediate unit shown at 40. The intermediate unit comprises a molded housing which carries the majority of the components of the electrical connector. In the present arrangement these are arranged in modular form and include a diagnostic unit shown at 41, a multi-way connector shown at 42, and a contact set shown at 43. The contact set includes customer IDC contacts 44, and telemetry IDC contacts 46. The intermediate unit also carries a contact unit 50, which provides a connection for an incoming line.

Disposed behind the intermediate unit is a molded backing plate 52. It will be appreciated that in normal operation the elements shown in exploded form in FIG. 2 are connected together to form a single unitary slim unit.

Figure 3:
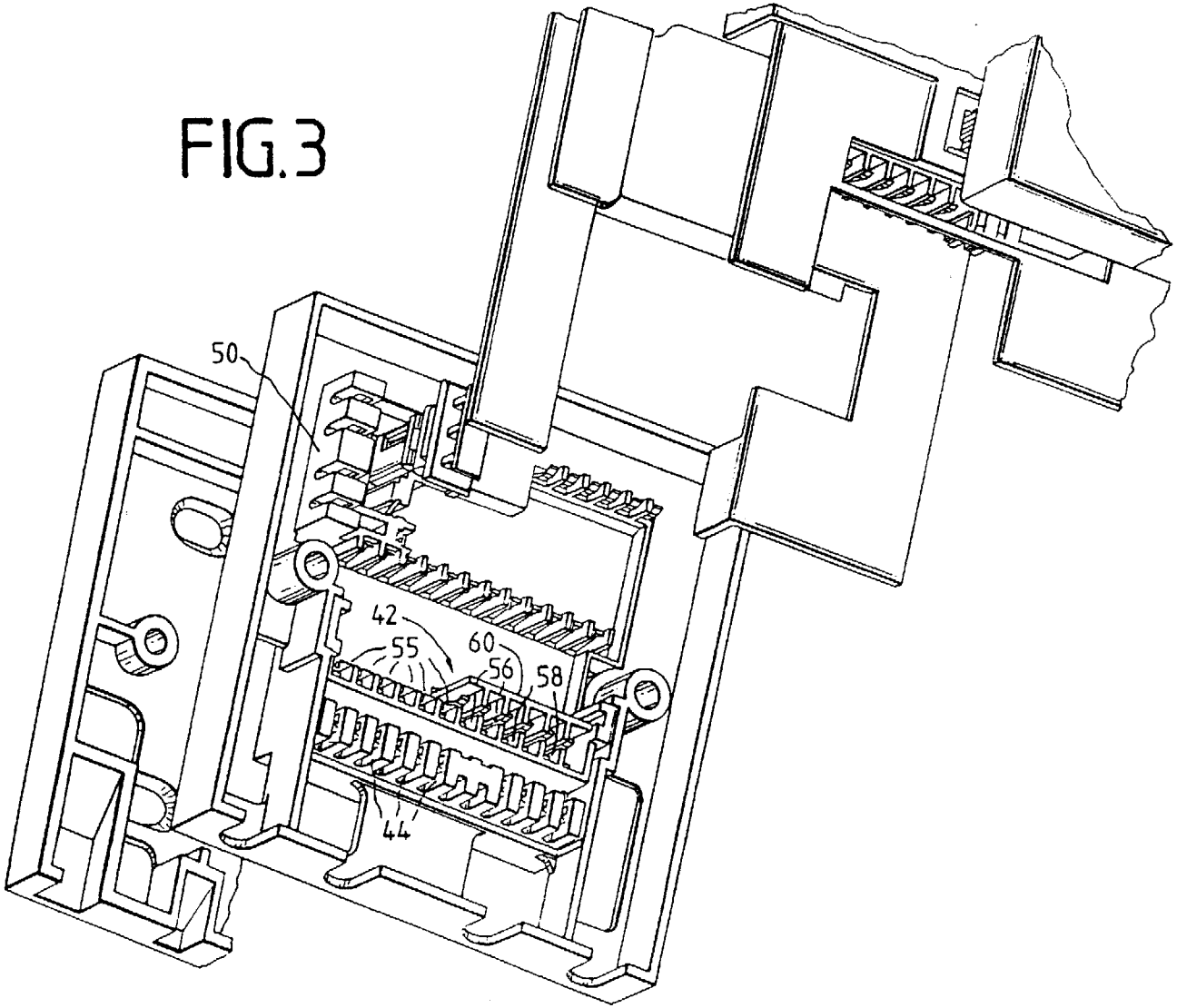
FIG. 3 is a view similar to FIG. 2, but showing on an enlarged scale the intermediate unit of the connector.
Figure 4:
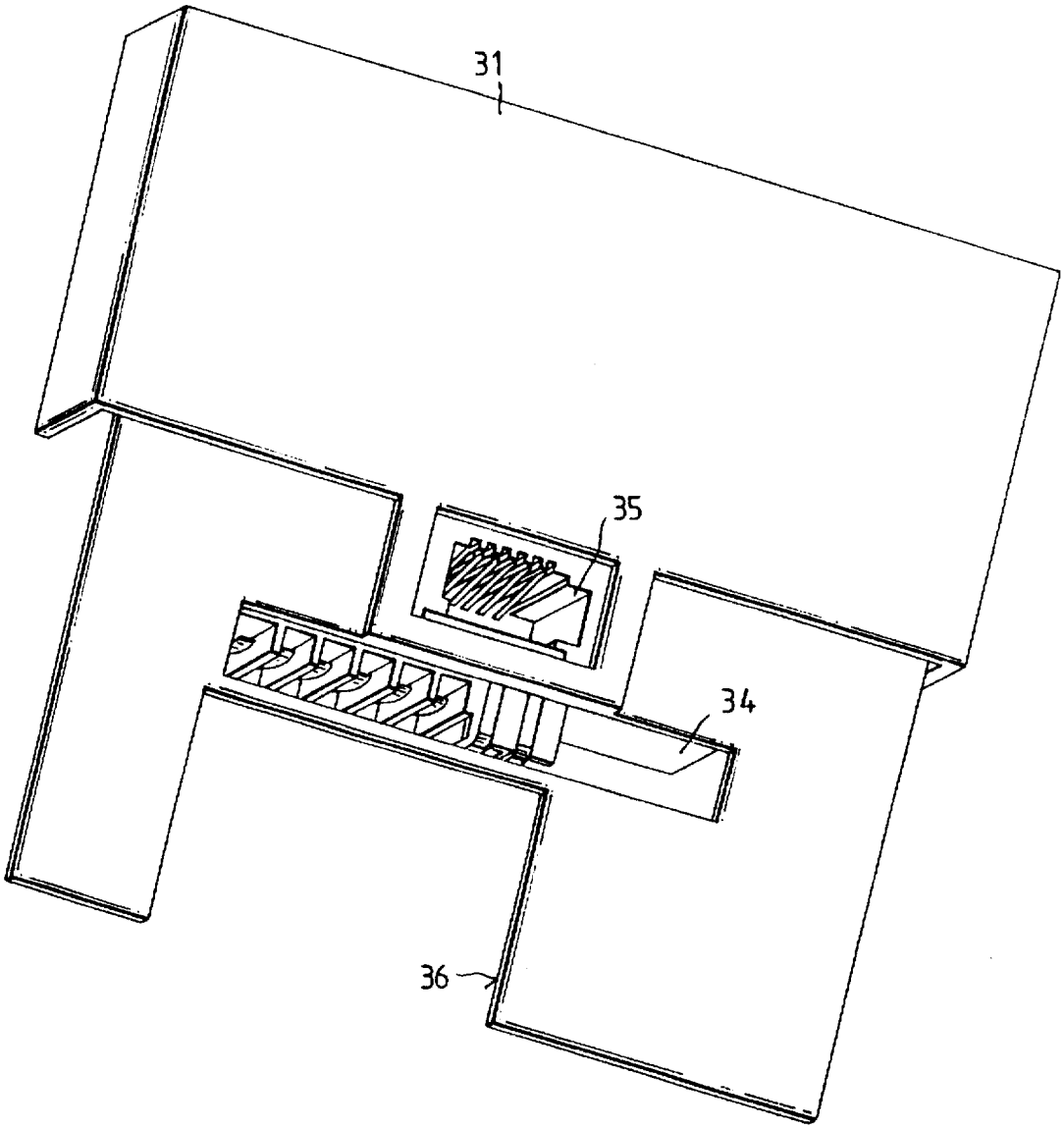
FIG. 4 is a front view partially in perspective of the front plate.
Figure 5:
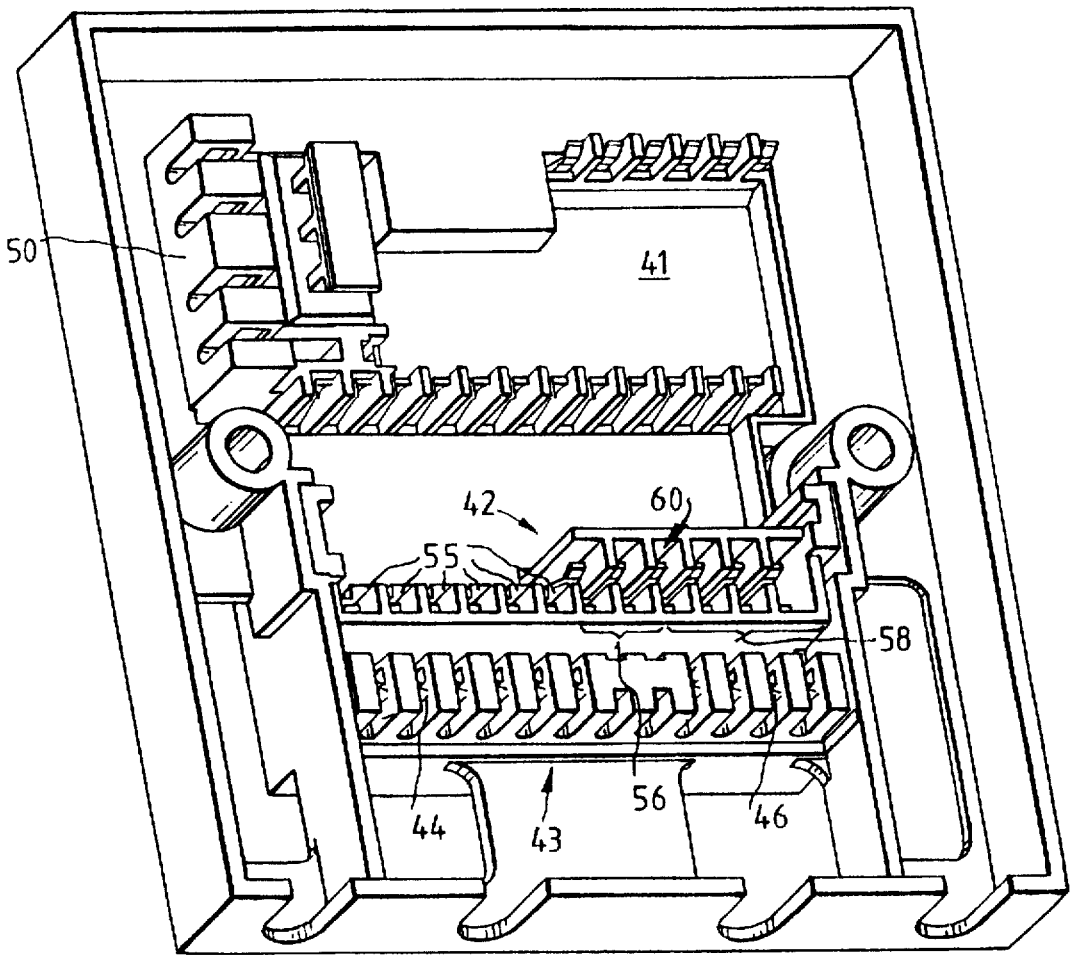
FIG. 5 is a front view partially in perspective of the intermediate unit.

Referring now to FIGS. 3 and 5, it can be seen that the multi-way connector 42 includes a group of six contacts 55, which are spring contacts, which can be connected to the customer IDC contacts 44. The multi-way connector also provides two line contacts 56, four telemetry contacts 58 and six service ID contacts 60.

Figure 6:
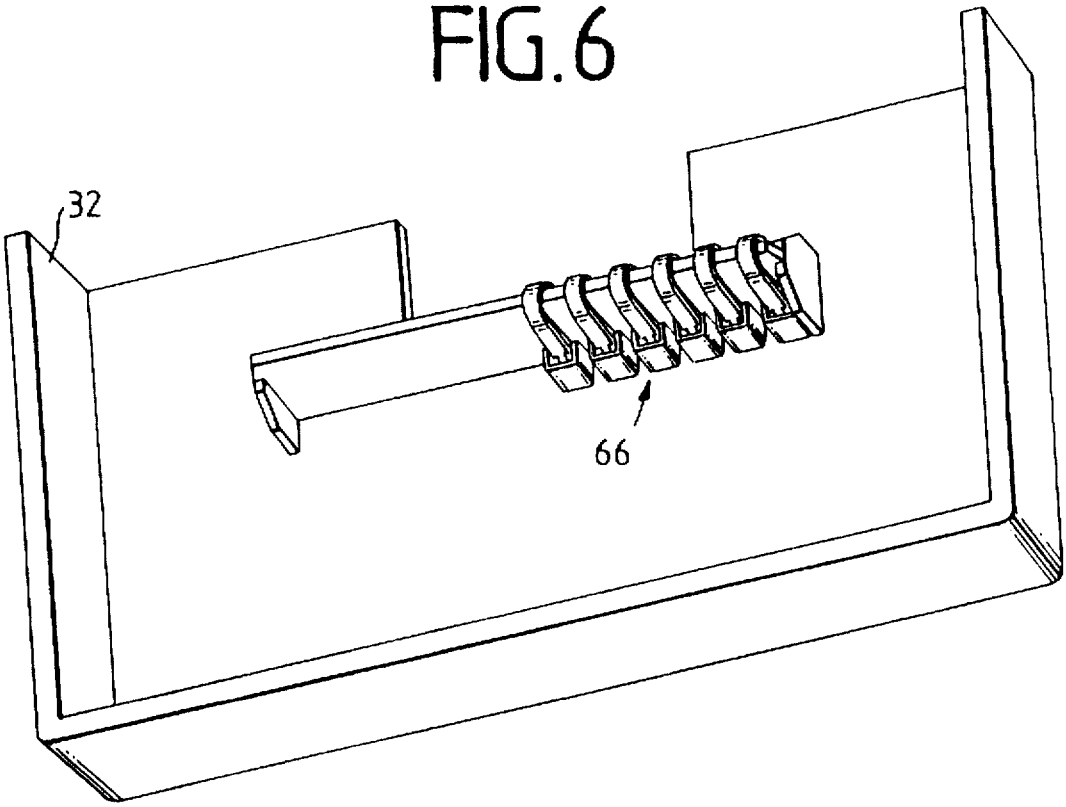
FIG. 6 is a perspective view showing the rear side of the access plate.

Referring to FIG. 6 it can be seen that on the rear face of the access plate there are provided a series of six contacts shown generally at 66. These contacts, when the access plate is in its operational condition, make contact through the opening 34 in the front plate 31 with the spring (sprung) contacts 55 of the multi-way connector 42. When the access plate is removed these contacts therefore move out of electrical connection with the contacts of the multiway connector and this provides the isolation facility referred to above in relation to FIG. 1.

Figure 8:
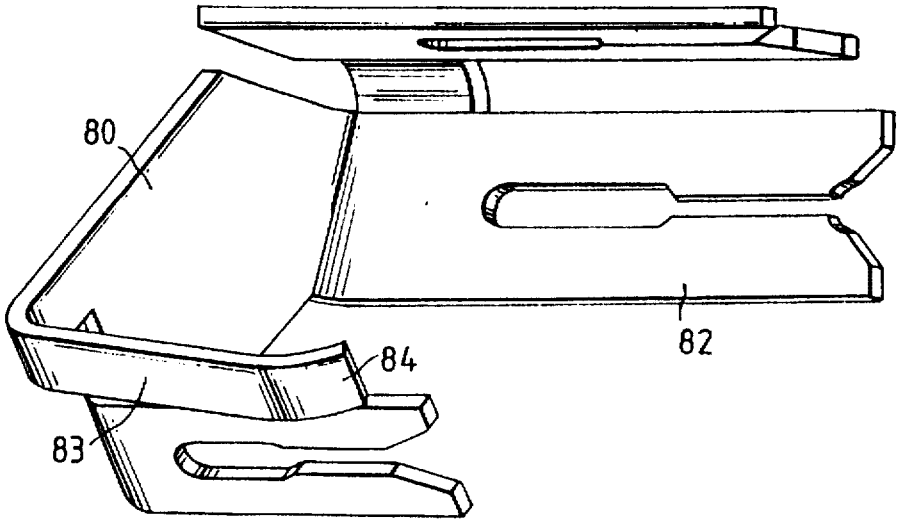
FIG. 8 is a perspective view illustrating a line in contact using the connector of FIG. 2.
Figure 7:
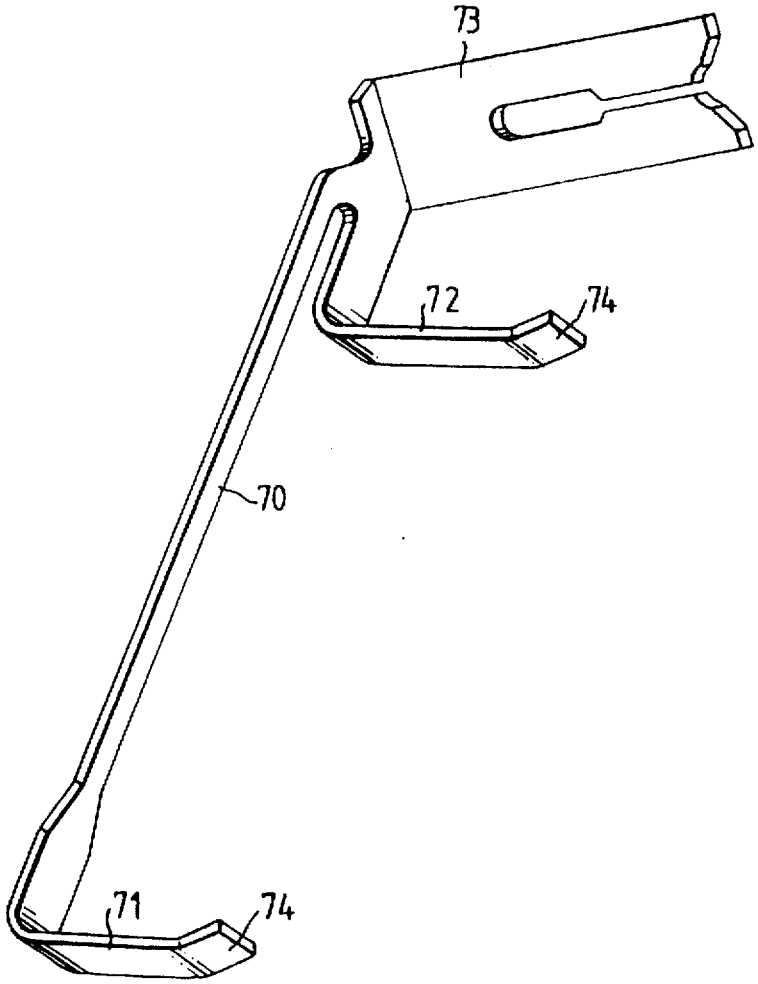
FIG. 7 is a perspective view showing a multipurpose contact of the present invention.
Figure 9:
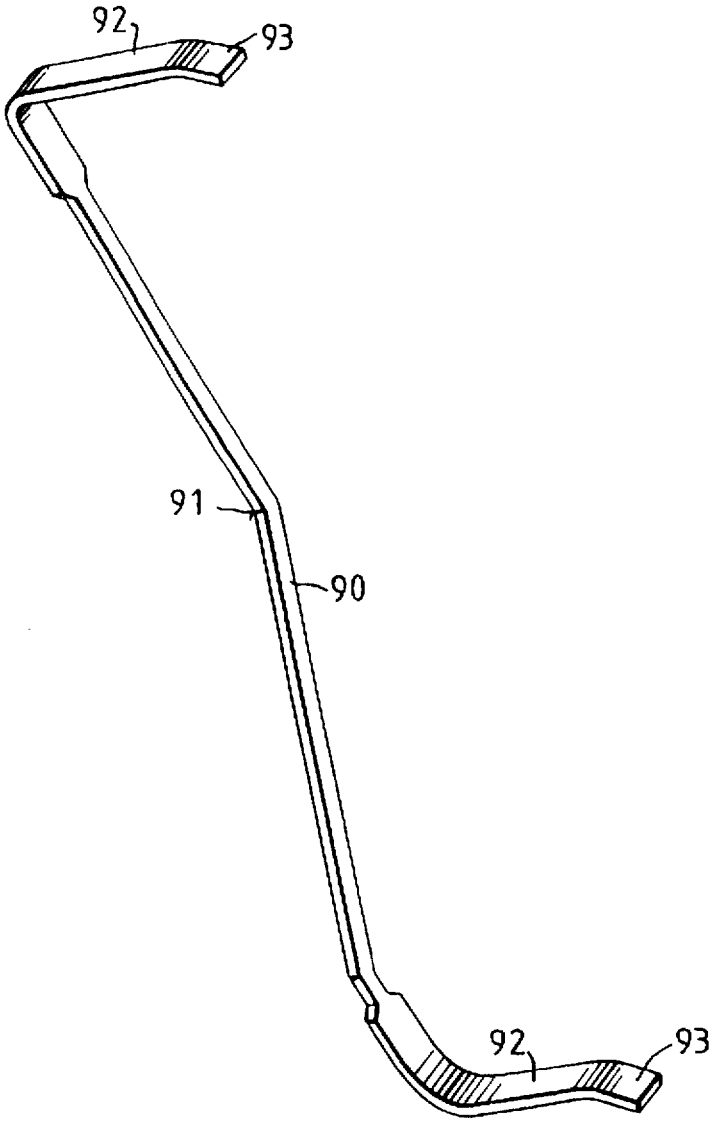
FIG. 9 is a perspective view showing a service ID contact using the connector of FIG. 2.

The elements on the intermediate unit are interconnected by contacts which are shown in FIGS. 7, 8 and 9. FIG. 7 shows a multipurpose contact which comprises an elongate strip-like portion 70 having projecting therefrom a plurality of arms shown at 71, 72 and 73. The two arms 71 and 72 each terminate in a flat contact element 74. The arm 73 is formed into an insulation displacement type contact which is well known per se in the art. The arms are formed at predetermined positions so that, as will be seen, from the description below they can make contact with the elements carried by the intermediate unit 40.

FIG. 8 shows a line in contact which includes a base part 80 and a number of upstanding IDC contacts 82 and a contact arm 83 which carries a flat contact element 84.

FIG. 9 shows what is termed a service ID contact which comprises an elongate strip-like portion 90 which has a slight bend formed at 91 and which is formed at each end with a contact arm 92 each of which carries a flat contact element 93.

Figure 10:
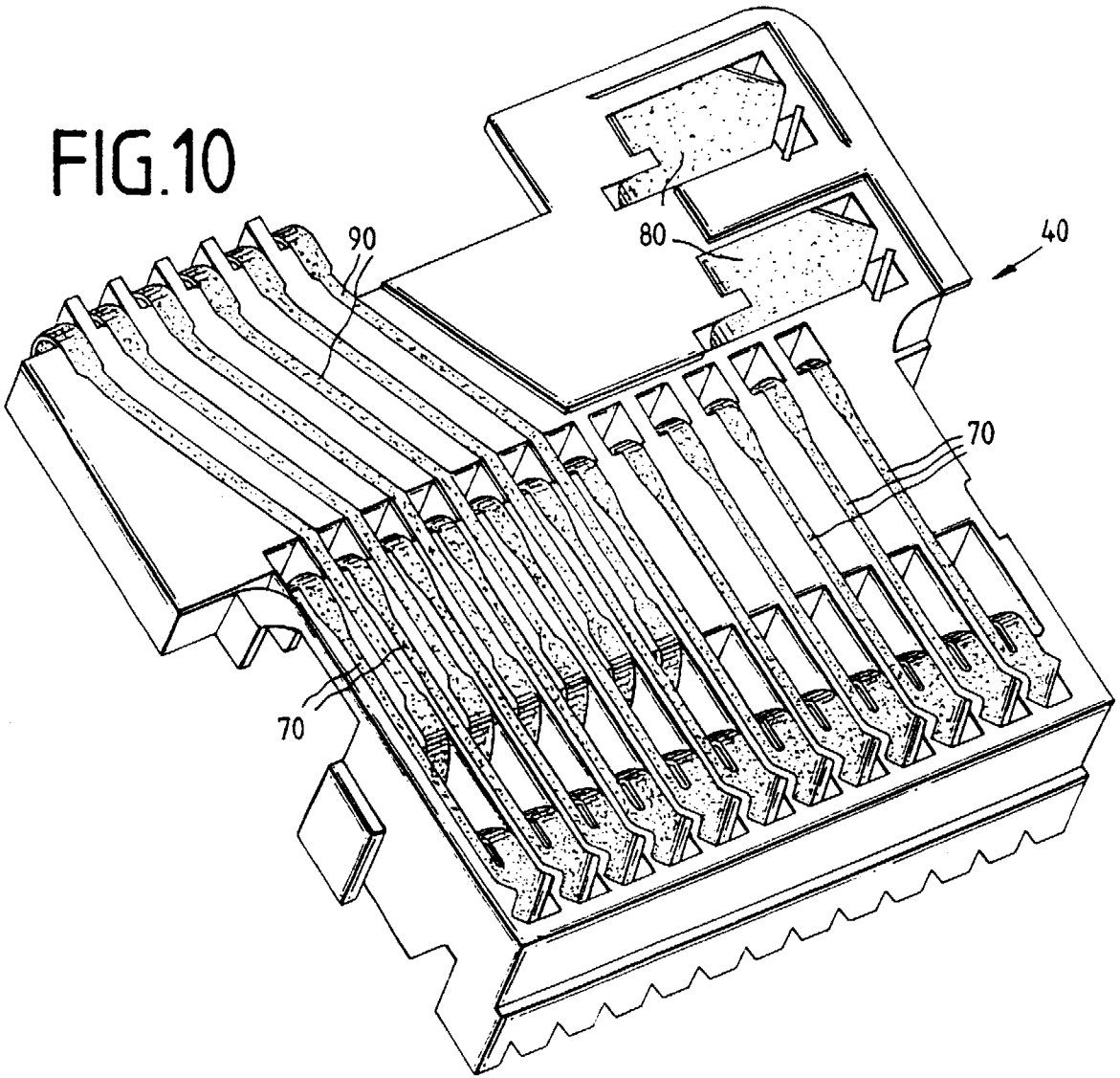
FIG. 10 is a perspective rear view of the intermediate unit showing the arrangement of the contacts of the present invention.

Referring now to FIG. 10 this illustrates the rear part of the intermediate unit 40. The drawing shows how the contacts of FIGS. 7 to 9 are used to interconnect the various elements carried by the intermediate unit. The multipurpose contacts of FIG. 7 are shown by the reference numeral 70 and it can be seen that twelve of these contacts are arranged side-by-side across the rear of the intermediate unit so that they make contact with the diagnostic unit 41, the multi-way connector 42 and the contact assembly 43 and interconnect them electrically in a preselected manner.

The unit makes use of two line in contact units of FIG. 8 and these are illustrated at 80. These are used to provide a connection between the incoming line and the diagnostic unit.

The connector also makes use of six service ID contacts which are shown generally at 90 and these make contact between the multi-way connector and the diagnostic unit.

The contacts, in particular the contacts of FIG. 7 are considered an important part of the present inventive design since they provide a simple and effective way of interconnecting the modular units of the present connector.

In use of the arrangement a customer can wire his own equipment to the customer IDC contacts 44. In order to do this the customer first removes the access plate 32, which effectively isolates the unit as described above. The customer then has access to the customer IDC contacts through the cutaway portion 36 of the front plate.

The six service ID contacts are used to provide a two digit code and this code is produced by commoning a preselected two of the contacts by way of a two-pronged commoning comb which is to be situated on the front plate multi-way connector. This is not shown in the drawings.

While specific embodiments of the invention have been shown and described in detail to illustrate the application of the principles of the invention, it will be understood that the invention may be embodied otherwise without departing from such principles.

What is claimed is:

1. An electrical connector for use as a network terminating apparatus, the connector comprising:

a cover plate assembly;

an intermediate unit, disposed behind said cover plate assembly;

diagnostic circuitry carried by said intermediate unit;

an assembly of connecting means being carried by said intermediate unit;

a contact assembly carried by said intermediate unit; and a set of substantially identical contact elements, which extend between and interconnect said diagnostic circuitry, said assembly of connecting means and said contact assembly.

2. An electrical connector according to claim 1, wherein said assembly of connecting means comprises a multi-way connector.

3. An electrical connector according to claim 1, wherein each contact element comprises an elongate strip-like, electrically conductive portion from which project, generally orthogonally, a plurality of contact arms, each said arm being disposed at a predetermined position so that it can make electrical contact with one of said diagnostic circuitry, said assembly of connecting means and said contact assembly.

4. An electrical connector according to claim 3, wherein one of the contact arms includes an insulation displacement type contact.

5. An electrical connector according to claim 1, wherein said cover plate assembly includes a removable access plate which, when removed, enables a customer to gain access to preselected contacts enabling that customer to carry out wiring.

6. An electrical connector according to claim 5, wherein said access plate carries access plate contacts, said access plate contacts electrically isolating the electrical connector when the access plate is removed.

7. An electrical connector for use as a network terminating apparatus, the connector comprising:

a cover plate assembly;

an intermediate unit, disposed behind said cover plate assembly;

diagnostic circuitry carried by said intermediate unit;

an assembly of connecting means being mounted on said intermediate unit;

a contact assembly mounted on said intermediate units; and a set of substantially identical contact elements, wherein said contact elements each comprise an elongate, strip-like, electrically conductive portion from which project, generally orthogonally, a plurality of contact arms, said arms being disposed at predetermined positions so that they can make electrical contact with one or more elements mounted on said intermediate unit of the electrical connector.

8. A contact according to claim 7, wherein one of said contact arms is formed with an insulation displacement type contact.

* * * * *